Figure 1:
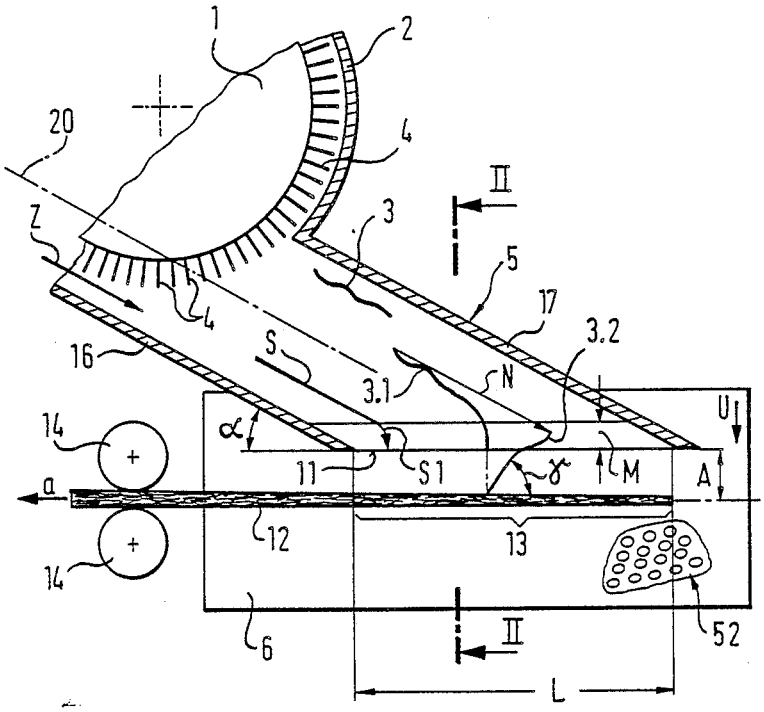

FRICTION SPINNING MACHINE

This invention relates to a friction spinning machine.

Many kinds of friction spinning machine are known from the patent literature. For example, there are arrangements having two cylindrical rollers, rollers with concave surfaces, rollers disposed one inside another and rollers or conical rollers co-operating with perforated tapes or perforated discs. In most cases there are two co-operating members, at least one of which has a perforated surface subjected to suction.

There have already been a whole series of suggestions for producing a practical friction spinning machine by a special design of individual geometrical and air technology parameters. The previous tests and investigations relate, for example, to the length and width of the suction slot of the suction nozzle, to the shape of the fibre feed duct, to the provision of further suction ducts on the fibre feed duct in order to act on the position of the fibres in flight, the shape and position of the outlet of the fibre feed duct, to the angle of inclination of the longitudinal axis of the fibre feed duct relative to the yarn draw-off direction, to the question whether the fibres should be brought into the yarn-forming station on the roller or should be fed directly to the yarn tail, to the air speed in the duct, to the exit angle of the fibres from the fibre feed duct, to the run-out movement of the fibres, to the angle of inclination of the fibre feed duct longitudinal side edges and to the yarn draw-off speed.

Despite all these proposals, only a relatively few friction spinning machines have been marketed and even these few are actually suitable only to produce relatively coarse cotton yarns, for example, for the subsequent production of jeans materials.

It is very difficult to devise friction spinning machines to be suitable for the economic production of relatively fine yarns without the need for a large number of time-consuming adjustments requiring great accuracy, more particularly upon a changeover from one yarn size to another.

It is the Applicants' view that the reason for these problems is that in practice guidance of the fibres is often unsatisfactory.

To obviate this difficulty, an open-end friction spinning method of producing a yarn or the like has alread been proposed in EP No. 175 862 wherein:

fibres are separated out from a fibre sliver;

the detached fibres are transferred in free flight by a pneumatic fibre-conveying airstream to a moving perforated surface of friction spinning means at a negative pressure, such air flow being directed at least until shortly before the perforated surface, at an inclination thereto;

the fibres are then conveyed by means of this perforated surface and in substantially stretched form to a yarn-forming station where the fibres are formed into a yarn, and the yarn is drawn off from the yarn-forming station in a predetermined direction, with the special feature that by a deliberate selection of both the airstream speed in the cross-section of an outlet of a fibre feed duct guiding such airstream, the outlet being directed towards the moving surface, and also of the speed at which the perforated surface moves past such outlet, the fibres conveyed on the moving surface are delivered to the yarn-forming station in a substantially stretched position and simultaneously in a rearwardly inclined position on the surface relative to the yarn draw-off direction.

These features already led to greatly improved results. However, it finally emerged that the spread of the angles taken up by the fibres was in some circumstances too great for ideal results. To overcome this difficulty it is proposed in EP-A No. 208 274 that the conveying airstream be additionally accelerated in a predetermined zone of a predetermined height at the end of the fibre feed duct outlet, with the airstream being accelerated in said zone and deflected towards the outlet such that a front end part of a free-flying fibre engaged in this zone (as considered in the fibre flight direction), is deflected from the said flight direction, which extends at an acute angle $\alpha$ to the outlet, into a position at a greater inclination to the outlet than the remainder of this fibre and is delivered in this position through the outlet to the perforated surface of the friction spinning machine.

These two European specifications and their foreign equivalents are still valid and their contents are hereby made part of the contents of the present Application.

It is the object of this invention to provide a low-cost friction spinning machine which has a low energy consumption and can produce a high-quality yarn over a wide range of yarn sizes at high yarn draw-off speeds, with yarn breakages and yarn defects occurring relatively infrequently during production.

To solve this problem the invention provides, a friction spinning machine residing in the combination of the following features:

(a) a perforated cylindrical roller rotatable around its axis in a first direction of rotation and having in it a suction nozzle having an outlet in the form of an elongate slot extending at least substantially parallel to such axis, the outlet being present between a first longitudinal edge of the suction nozzle and a second longitudinal edge thereof, such edges being disposed very near the inside of the perforated wall of the perforated cylindrical roller;

(b) a second and imperforate cylindrical roller rotatable around its axis in the same direction of rotation as the first and perforated roller, the rotational axis of the imperforate roller extending parallel to the rotational axis of the perforated roller, the two rollers co-operating to bound between them a narrowest gap or nip in a plane containing the two rotational axes;

(c) a fibre feed duct which is disposed on that side of the nip where the surface of the perforated roller rotates into the nip and the surface of the imperforate roller rotates out of the nip;

(d) the diameter of the two rollers is in the range of from 40 to 60 mm, the ratio of the diameter of the perforated roller to the diameter of the imperforate roller being in the region of from 0.5 to 2, preferably between 0.75 and 1.50 and more particularly approximately 1.00;

(e) the distance between the roller surfaces in the very narrow nip is between 0.10 and 0.35 mm;

(f) that longitudinal edge of the suction nozzle which is adjacent the nip has a distance from the plane interconnecting the two rotational axes by a distance which is in the range of from 2 mm on that side of the plane which is remote from the fibre feed duct to 2 mm on that side of the plane which is near the fibre feed duct;

(g) the second longitudinal edge of the suction nozzle is remote from the plane interconnecting the two rotational axes on that side of such plane which is near the fibre feed duct in a range of from 4 mm to 10 mm;

For the rest, the outlet 11 is disposed substantially parallel to and at a predetermined distance A from the yarn-formation position 13.

Assuming that the opposite top duct wall 17 extends substantially parallel to the bottom duct wall 16, the air flow in the duct takes up an at least similar inclination to the outlet cross-section.

Figure 2:
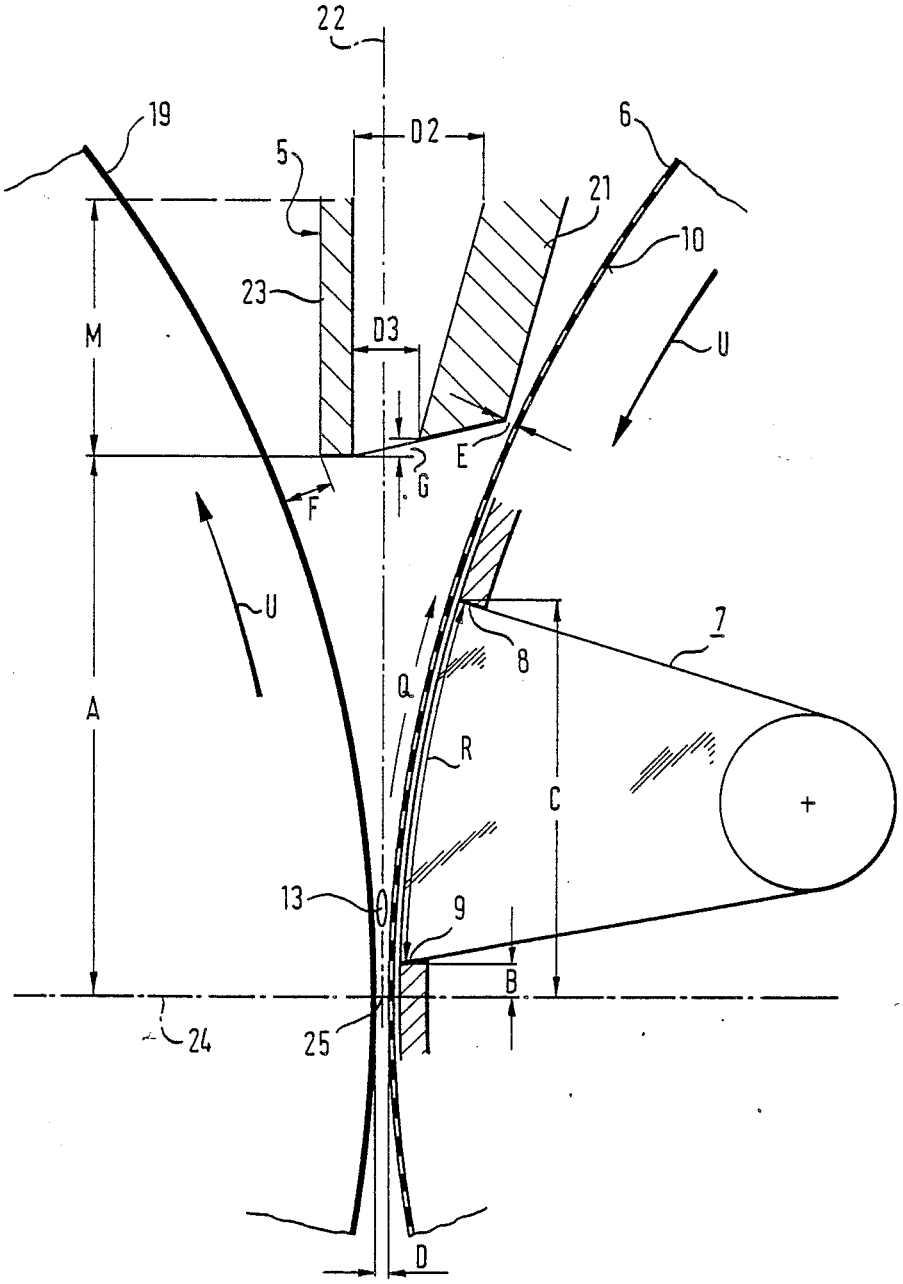

As FIG. 2 shows, the fibre feed duct has in the outlet zone a sharply narrowing part of height M, such part narrowing from a duct width D2 to a duct width D3.

As can be gathered from FIG. 2, this narrowing is effected mainly by an inclination of that longitudinal side wall 21 of the duct 5 which is on the right in FIG. 2. The left side wall 23 extends at least substantially parallel to the plane of symmetry 22 between the perforated roller 6 and the imperforate roller 19.

This kind of narrowing has the special advantage that because of the inclined right-hand wall 21 the fibres are delivered at least substantially tangentially to the surface zone Q of the perforated roller 10, an important consideration for the purposes of the invention.

In operation, the fibres detached from the sliver by the needles of the opening roller 4 are engaged by the air stream Z, which flows past the needles substantially tangentially to the roller 1, and are further conveyed in the fibre feed duct 5 as free flying fibres. The air flow in the fibre feed duct 5 has the reference S.

The air flow S is accelerated in the narrowed outlet zone of height M in accordance with the cross-sectional variation due to the change in the internal width of the duct 5 from D2 to D3, and is then picked up by the suction duct 7 through the perforated friction spinning roller 6.

In this acceleration zone the air flow S is deflected towards the peripheral direction of the perforated friction spinning roller 6, as indicated by a curve S1 in the arrow S, so that the part which is at the front, as considered in the flow direction, of a fibre 3 delivered in such direction is also deflected in this acceleration zone in accordance with the airflow S, is then engaged by the perforated roller 6, as represented by the fibre position 3.1, and is drawn off in the peripheral direction of the perforated roller 6. The rear part of this fibre is conveyed onwards in the airstream in the direction indicated by an arrow N in FIG. 1 and is finally delivered in a fibre position 3.2 onto the surface of the perforated roller 6. The magnitude of the angle $\gamma$ (FIG. 1) defining the fibre position 3.2 depends upon the ratio of the airflow speed before the outlet zone of height M to the surface speed of the perforated roller 6 and upon the height M itself, upon the acceleration of the air in the last-mentioned outlet zone and upon the inclination angle $\alpha$ of the fibre feed duct 5. For example, the angle $\gamma$ decreases as the angle $\alpha$ decreases assuming that the said ratio between air speed and surface speed is large, the height M is adapted to the inclination of the duct 5 and the acceleration in the said outlet zone is sufficient to guide the said front end of the particular fibre concerned fast enough on to the perforated roller 6. Basically, as the angle $\alpha$ decreases the said ratio between air speed and the surface speed of the roller 6 must increase and, because of the reduced height M chosen, the acceleration in the last-mentioned outlet zone must be increased.

It has been found that the speed of the conveying air in the outlet must be at least 50% greater than the speed at the entry of the said zone—i.e., at the duct width D2—for adequate deflection of a front end of a fibre.

Also, the narrowed zone before the outlet must be only so high that the front end of a fibre engaged by such zone must be at most one-third of the length of an average fibre to be processed. The height M of this narrowing should therefore be approximately 10 mm.

It was also found that the speed of the conveying air in the outlet 11 should be not more than five times the speed at the duct width D2 at the start of this zone. Advantageously, the speed of the conveying air in the outlet 11 is between twice and four times its speed in the duct width D2.

However, the speed of the airstream above the said narrowed zone must be greater than the surface speed of the perforated roller 6 to ensure that the fibres do not take up a position substantially in the direction of movement of the roller 6.

It has also been found that the speed of the conveying airstream above the narrowed zone must increase with a decreasing inclination angle $\alpha$ of the duct 5 in order to bring the fibre into the position 3.2 at the required angle $\gamma$. For example, if the inclination angle $\alpha$ of the duct 5 is between 30° and 10°, the said air speed should be between 15 and 100 m/sec.

The inclination angle $\gamma$ of the fibres 3 in the position 3.2 is also decreased when the speed of the airstream above the narrowed zone increases while the speed of movement of the friction spinning means remains constant. The speed of the said airflow must be at least twice the surface speed of the perforated roller 6.

Many of the considerations set out in the foregoing have already been disclosed in EP No. 208 274; this publication also contains particulars on the preferred perforation arrangement 52 which is valid in the present context.

FIG. 2 shows a number of other distances or gaps or nips or the like which if correctly chosen and in combination with the features hereinbefore considered lead to a satisfactory result. These distances or gaps or the like are the distance B between the bottom longitudinal edge 9 of the suction duct 7 and the plane 24 interconnecting the two rotational axes of the rollers, the gap C between the top longitudinal edge 8 of the suction duct 7 and the same plane 24, the distance D between the perforated roller 6 and the imperforate roller 19 at the narrowest gap or nip 25 in the plane 24, the radial distance E between the longitudinal side wall 21 of the fibre feed duct 5 and the perforated roller 6, the radial distance F between the imperforate roller 19 and the left longitudinal side wall 23 of the fibre feed duct 5 and the height difference G between the left and right side walls 23, 21 respectively of the fibre feed duct 5.

In a practical construction in which each of the cylindrical rollers 6, 19 had a diameter of 45 mm the following dimensions were chosen:

A=9 mm
B=0.5 mm
C=6 mm
D=0.15 mm
E=0.2 mm
F=0.7 mm
G=0.1 mm
M=10 mm
$\alpha$=25°

Air speed at the fibre feed duct outlet=80 m/sec

Negative pressure in the suction duct 7=1500 mm water column

Negative pressure in the fibre feed duct 5 of 260 mm water column above the outlet Yarn draw-off speed = 200 m/min
Surface speed of each of the two rollers = 550 m/sec
Length L of the outlet 11 = 100 mm.

EXAMPLE 1

A 20 tex yarn of cotton fibres having a staple length of 1 1/16" (27 mm) was spun by a machine having these dimensions and had the following yarn properties:

CV % of yarn 15.4
Strength in terms of breaking length in kilometres 9.8
Elongation E (%) 7.6
CV P (%) 12.0
Thin zones per kilometre 95
Thick zones per kilometre 75
Neps per kilometre 375.

EXAMPLE 2

The choice of the two radial distances E, F is very important. The specified values of 0.2 to 0.7 mm represent an optimum and even relatively small deviations lead to an appreciable deterioration of the negative pressure in the fibre feed duct and of yarn strength. However, the position of the output 11 relatively to the symmetry plane 22 is not at all critical. Although FIG. 2 shows a symmetrical position the outlet 11 can be "displaced" to the left or to the right in FIG. 2 without affecting yarn values provided that the specified radial distances are observed by screeing plates or by an appropriate thickness of the feed duct longitudinal side walls 21, 23.

We claim:

1. A friction spinning machine comprising (a) a perforated cylindrical roller rotatable in a first direction of rotation and having a suction nozzle therein with an outlet in the form of an elongate slot present between a first longitudinal edge of said suction nozzle and a second longitudinal edge thereof, said edges being disposed very near the inside of a perforated wall of said perforated cylindrical roller;

(b) a second and imperforate cylindrical roller rotatable in the same direction of rotation as said perforated roller, the rotational axis of said imperforate roller extending parallel to the rotational axis of said perforated roller, the two rollers co-operating to bound between them a nip in a plane containing said two rotational axes;

(c) a fiber feed duct which is disposed on that side of the nip where the surface of the perforated roller rotates into the nip and the surface of the imperforate roller rotates out of the nip, said duct having a first longitudinal side wall adjacent said perforated roller and a second longitudinal side wall adjacent said imperforate roller;

(d) the diameter of the two rollers is in the range of from 40 to 60 mm, the ratio of the diameter of the perforated roller to the diameter of the imperforate roller being in the region of from 0.5 to 2;

(e) the distance between the roller surfaces in said nip is between 0.10 and 0.35 mm;

(f) that longitudinal edge of the suction nozzle which is adjacent the nip has a distance from the plane interconnecting the two rotational axes which is in the range of from 2 mm on that side of the plane which is remote from the fiber feed duct to 2 mm on that side of the plane which is near the fiber feed duct;

(g) the second longitudinal edge of the suction nozzle is remote from the plane interconnecting the two rotational axes on that side of such plane which is near the fiber feed duct in a range of from 4 mm to 10 mm;

(h) said first longitudinal side wall of said fiber feed duct forms an angle of from 0° to 20° with a symmetry plane through the nip perpendicularly to said plane interconnecting the two rotational axes, such angle being measured at that end part of said second longitudinal edge which is near the nip;

(i) said second longitudinal side wall of said fiber feed duct forms with said plane of symmetry an angle of from −10° to +10° measured at that end part of said second longitudinal side wall which is near the nip, the fiber being guided on to the perforate roller as far as possible in a plane tangential thereto by selection of the last-mentioned two angles and of the various air flows;

(j) the height of the center-line of the outlet formed by the fiber feed duct longitudinal edges facing the nip is at least 7 mm;

(k) said second longitudinal side wall of said fiber feed duct extends at least as far as, but not much further, towards the plane interconnecting the two rotational axes than said first longitudinal side wall of said fiber feed duct;

(l) the width of the fiber feed duct outlet is in the range of from 0.75 to 2 mm;

(m) the speed of the air flow which guides the fibers in the fiber feed duct is in the region of from 50 to 100 m/sec at the duct outlet;

(n) the negative pressure in the fiber feed duct as measured at a place 10 mm above the outlet is in the region of from 110 mm to 300 mm water column;

(o) the radial distance between the surface of the perforated roller and said first longitudinal side wall of said fiber feed duct is in the range of from 0.1 and 0.5 mm;

(p) the radial distance between the imperforate roller and said second longitudinal side wall of said fiber feed duct is in the region of from 1.0 to 0.5 mm;

(q) the yarn-forming station is disposed between the fiber feed duct outlet and the nip;

(r) the angle $\alpha$ between the central longitudinal axis of the fiber feed duct and the yarn draw-off direction is an acute angle of from 15° to 40°;

(s) the yarn draw-off speed is in the region of from 150 to 300 m/min;

(t) the surface speed of the perforated roller is in the region of from 150 to 1200 m/min; and (u) the surface speed of the imperforate roller is in the region of from 95 to 105% of the surface speed of the perforated roller.

2. A spinning machine according to claim 1 wherein (v) the fiber feed duct is positioned to deposit the majority of the fibres on the surface of the perforated roller.

3. A machine according to claim 1 wherein (w) the length of the slot-like outlet of the fibre feed duct is in the region of 80 to 130 mm.

4. A machine according to claim 1 wherein (x) the distance between the perforated roller and the imperforate roller in the nip is 0.15 mm;

(y) the first longitudinal edge of the suction nozzle is disposed on that side of said plane interconnecting said two rotational axes which is near the fibre feed duct and is at a distance of 0.5 mm from said plane interconnecting said axes.

(z1) the second longitudinal edge of the suction nozzle is at a distance of 6 mm from said plane interconnecting said axes;

(z2) the end part of said second longitudinal side wall of said fiber feed duct extends substantially parallel to the said plane of symmetry and has an edge adjacent said plane interconnecting the two rotational axes which is at a distance of 9 mm from said plane interconnecting said axes;

(z3) the radial distance between the perforated roller and said first longitudinal side wall of said fibre feed duct is 0.2 mm;

(z4) the radial distance between the imperforate roller and said second longitudinal side wall of said fiber feed duct is 0.7 mm, and (z5) the width of the fibre feed duct outlet is 1.0 mm.

* * * * *

United States Patent [19]

Angell et al.

[11] Patent Number: 4,938,019

[45] Date of Patent: Jul. 3, 1990

[54] FUEL NOZZLE AND IGNITER ASSEMBLY

[75] Inventors: Fenton L. Angell, Novi; Theodore R. Koblish, Birmingham, both of Mich.

[73] Assignee: Fuel Systems Textron Inc., Walled Lake, Mich.

[21] Appl. No.: 423,653

[22] Filed: Oct. 18, 1989

Related U.S. Application Data

[63] Continuation of Ser. No. 109,580, Oct. 16, 1987, abandoned.

[51] Int. Cl.[5] ..... F02C 7/266

[52] U.S. Cl. ..... 60/39.06; 60/748; 60/39.827

[58] Field of Search ..... 60/39.827, 748, 39.821, 60/39.06, 39.141

[56] References Cited

U.S. PATENT DOCUMENTS

| | | | |
|---|---|---|---|
| 2,459,286 | 1/1949 | Rabezzana et al. | 60/39.827 |
| 3,057,159 | 10/1962 | Benedict . | |
| 3,330,985 | 7/1967 | Johnston | 60/39.827 |
| 3,548,592 | 12/1970 | Hopkins | 60/39.827 |
| 3,684,186 | 8/1972 | Helmrich | 60/742 |
| 3,893,296 | 7/1975 | Fredriksen . | |
| 3,937,011 | 2/1976 | Carvel et al. | 60/748 |
| 3,980,233 | 9/1976 | Simmons et al. | 60/748 |
| 4,023,351 | 5/1977 | Beyler et al. | 60/748 |
| 4,215,979 | 8/1980 | Morishta . | |
| 4,412,810 | 11/1983 | Izuha et al. . | |

OTHER PUBLICATIONS

Gas Turbine Combustion, Arthur W. Lefebure, 1983, pp. 222–230.

Drawing #700–005, Oct. 22, 1973, Ex-Cell-O Corp.

*Primary Examiner*—Donald E. Stout

*Attorney, Agent, or Firm*—Reising, Ethington, Barnard, Perry & Milton

[57] ABSTRACT

An elongate igniter is disposed in the inner air chamber of an air blast nozzle coaxial with the longitudinal axis thereof such that the discharge tip of the igniter discharges a spark generally longitudinally downstream of the tip out of the path of swirling inner air flow and in the path of a reverse flow field of atomized fuel established downstream of the tip by relatively controlled inner and outer air swirl strengths.

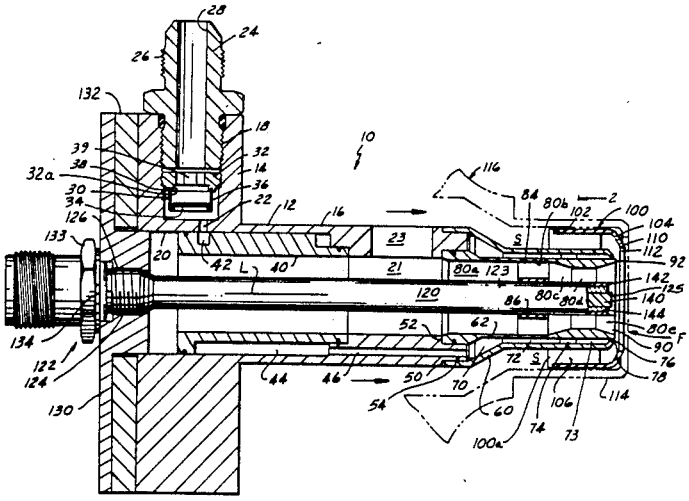

19 Claims, 2 Drawing Sheets